US007225767B1

(12) United States Patent
Hickey

(10) Patent No.: US 7,225,767 B1
(45) Date of Patent: Jun. 5, 2007

(54) CONVERSION OF AN AIR-COOLED ENGINE TO LIQUID COOLING

(76) Inventor: John Curtis Hickey, 1160 W. Huron River Dr., Belleville, MI (US) 48111

( * ) Notice: Subject to any disclaimer, the term of this patent is extended or adjusted under 35 U.S.C. 154(b) by 0 days.

(21) Appl. No.: 10/890,423

(22) Filed: Jul. 13, 2004

(51) Int. Cl.
*F02F 1/36* (2006.01)

(52) U.S. Cl. ..... 123/41.82 R; 123/41.69

(58) Field of Classification Search ..... 123/41.82 R, 123/41.69, 41.57, 41.81
See application file for complete search history.

(56) References Cited

U.S. PATENT DOCUMENTS 679,410 A * 7/1901 Birddall ..... 123/41.57
2,252,914 A * 8/1941 Balton ..... 123/65 BA
2,401,631 A * 6/1946 Gernandt ..... 123/80 DA
2,415,155 A * 2/1947 Wyatt ..... 123/41.76
4,630,345 A 12/1986 Lutz
4,825,816 A * 5/1989 Yamada et al. ..... 123/41.57
5,404,846 A 4/1995 VanRens
5,755,190 A 5/1998 Ronen
6,334,412 B1 1/2002 Kaita
6,408,803 B1 * 6/2002 Atkins ..... 123/41.81

* cited by examiner

*Primary Examiner*—Stephen K. Cronin
*Assistant Examiner*—Katrina Harris
(74) *Attorney, Agent, or Firm*—William P. Hickey

(57) ABSTRACT

In some aspects of the invention the invention will relate to conversion of an existing VW air cooled engine to liquid cooling, and in still further aspects it will relate to the design of a water jacket to maximize heat rejection of a combustion chamber and piston through perimeter cooling.

19 Claims, 2 Drawing Sheets

CONVERSION OF AN AIR-COOLED ENGINE TO LIQUID COOLING

The present invention relates to internal combustion engines generally, and more particularly to internal combustion engines of the otto cycle type. In some aspects of the invention the invention will relate to conversion of an existing VW air cooled engine to liquid cooling, and in still further aspects it will relate to the design of water jacket to maximize heat rejection of a combustion chamber through perimeter cooling.

BACKGROUND OF THE INVENTION

The maximum power and efficiency that an internal combustion engine is capable of is limited by knock. This can occur when gasses during the compression stroke reach a temperature and pressure where they spontaneously combust. Cooling the combustion gasses allows higher pressures & hence power and efficiency.

Another problem that exists in internal combustion engines, particularly those that are air-cooled, stems from the fact that rich mixtures are used to cool cylinder heads and or exhaust system to improve durability. This approach to cooling not only increases fuel consumption but it also increases the output of environmentally troublesome emissions. At maximum power with heads of this invention it is not necessary to operate with rich mixtures for cooling or to avoid knock.

In air and liquid cooled engines alike, the combination of cyclical thermal stresses and reduced material properties are causal factors leading to cracking. These cracks often occur between the inlet and outlet valves seats or spark plug holes. This area is generally the hottest temperature surrounding the combustion chamber, and in prior art heads often exceeds 475° F. At this temperature aluminums tensile and yield strength is half of what it is at 320° F. The heads of the present invention do not exceed 320 F.

In some prior art engines, including diesel engines, inadequate cooling of the heads produce warping that can interfere with the sealing necessary between the heads and cylinder block.

In the case of liquid cool automotive engines, the head and cylinder block are sealed by a gasket. This requires that the cylinder block be provided with a thick plate like top surface called a deck. The heads are likewise provided with a thick plate like structure adjacent to the combustion chamber. Between these two plate structures the gasket is squeezed to seal water and combustion gasses. These thick plate like structures are in the high temperature areas of the head, significantly reducing heat transfer from the combustion chamber and piston rings into the coolant.

Another problem that occurs in engines is when thermal expansion of the head produces excessive stress on the studs used to secure the head to the crankcase. Excessive stresses on these studs can cause distortion of cylinder bores and cracks in the crankcase. This is particularly true when the case is made of aluminum and/or magnesium.

Another problem is that the valves, ports and spark plugs reduce the area of contact between the coolant and combustion chamber. This is particularly true in cases where 4 or 5 valves per cylinder are used. As will be explained later, the intent of the present invention is to increase the surface area of contact between the coolant and combustion chamber by creating a skirt around the perimeter of the combustion chamber. In the preferred embodiment said skirt extends downward to encompass the piston and rings.

My objectives are to solve all of these problems.

It will become apparent to those skills in the art to which this invention relates how the problems listed above are solved by my invention.

These and still other objects and advantages of the invention will become apparent to those skilled in the art to which the invention relates from the following description of the preferred embodiments taken with the accompanying drawings.

DETAILED DESCRIPTION OF THE PREFERRED EMBODIMENTS

Figure 1:
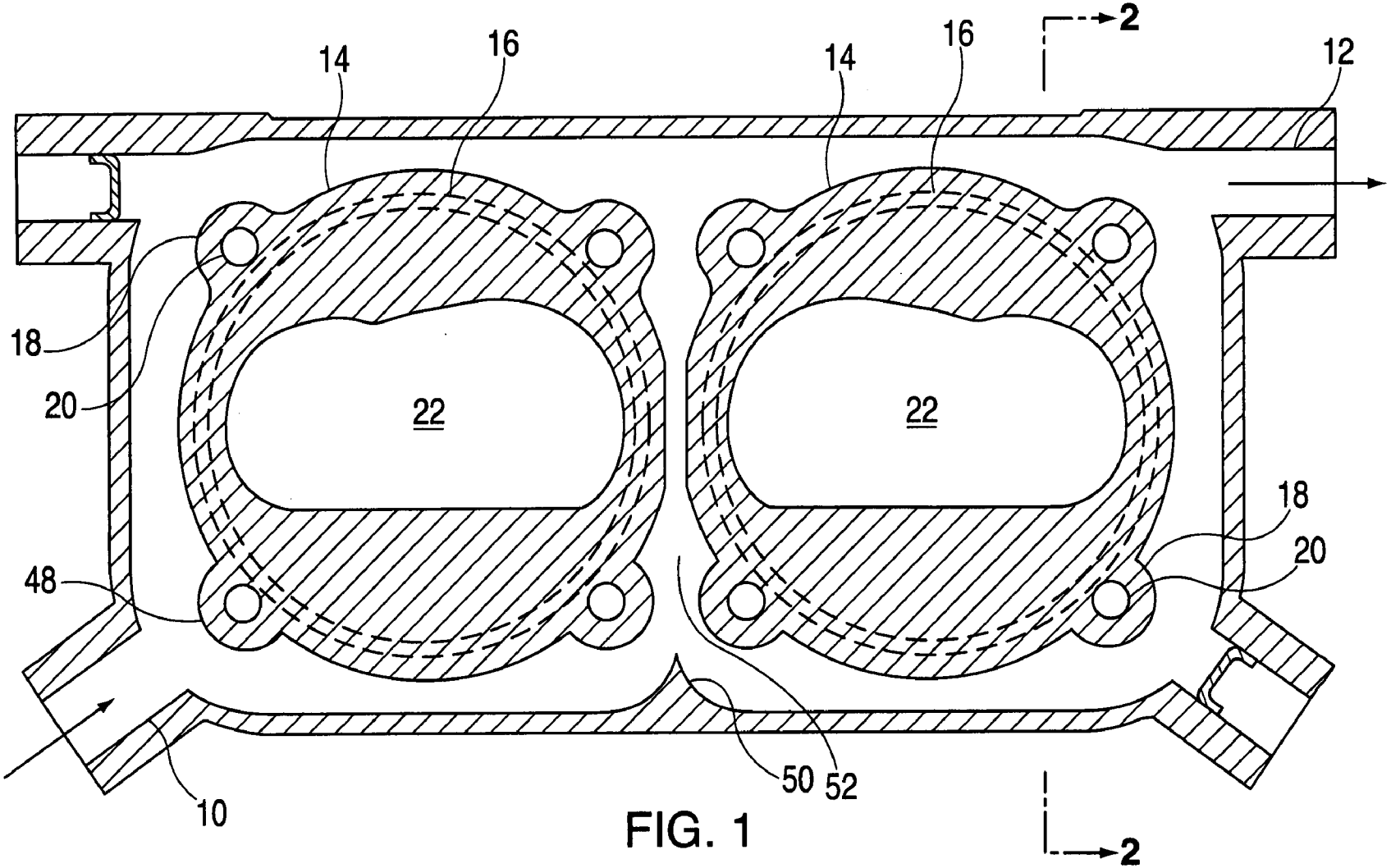
FIG. 1 is a sectional view of the cylinder head normal to the cylinder axis of an opposed 4 cylinder engine. The section passes through the combustion chamber roof and extends through the coolant inlet and outlet ports.
Figure 2:
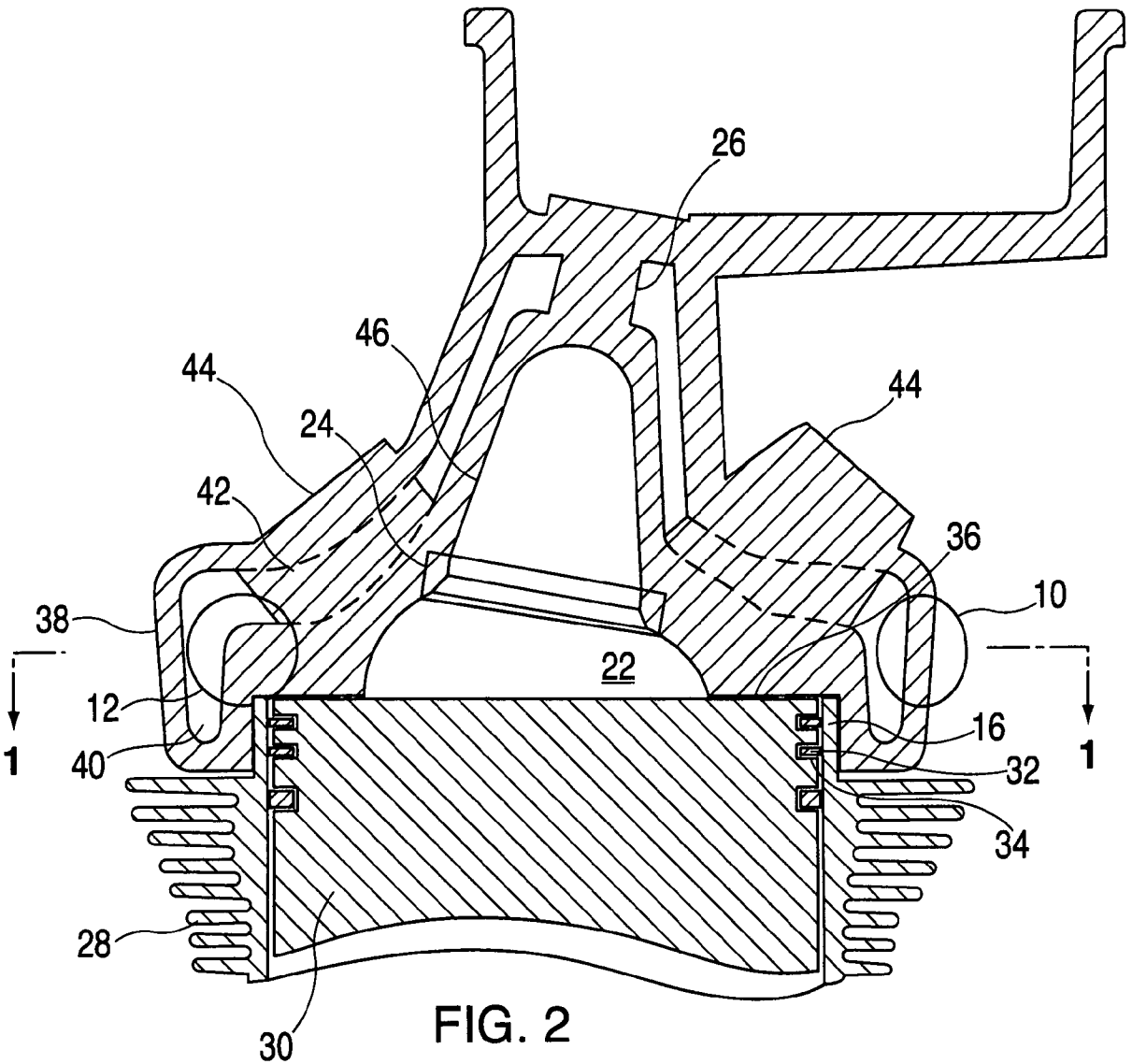
FIG. 2 is a vertical sectional view taken approximately on the line 2—2 of FIG. 1.

There is shown in the drawings, one head of a horizontally opposed four-cylinder engine. The head is liquid cooled and as such FIG. 1 is a sectional view that passes through the coolant inlet port and through the coolant outlet port. As best seen in FIG. 2, FIG. 1 passes through the dome shaped combustion chamber so that an irregularly shaped opening is seen. In between the coolant inlet port 10 and the coolant outlet port 12, FIG. 1 passes through two cast aluminum cylindrical caps 14, each of which is positioned over a respective cylinder barrel 16 shown by concentric lines. Each has four equally spaced ears 18 having openings 20 through each of which a hold down stud, not shown, passes.

FIG. 2 is a vertical transverse section that passes through the center of the exhaust valve seat 24 and valve guide 26 for the cylinder 16 shown at the right of FIG. 1. FIG. 2 also shows the top end portion of the cylinder barrel 16 that has air-cooling fins 28 thereon. FIG. 2 also shows the top end of a piston 30 having two compression rings 32 received in their respective grooves 34. The piston is shown in its top dead center position. Above each piston is the dome shaped combustion chamber 22. Between the top of the piston and the edge of the combustion chamber 22, is what is called, the squish region 36 of the combustion chamber.

The head has a skirt 38 which extends down past the squish region 36 to below the bottom compression ring 32 of the piston when in its top dead center position. Inside the skirt 38 is a liquid cooling chamber 40 to which the coolant inlet port 10 and the coolant outlet port 12 communicate. The head also has an upper portion 42 of its cooling chamber that extends upwardly past the intake valves and exhausts valve seats 24 of each cylinder and then surrounds the exhaust valve guide 26. Also shown in FIG. 2 are two spark plug bosses 44. As best shown by dotted lines in FIG. 2, the upper portion of the cooling chamber overlies the complete combustion chamber 22 except where it passes around the intake and exhaust passageways 46 adjacent the valve seats 24.

The coolant inlet port 10 communicates with both the skirt cooling chamber 40 and the upper cooling chamber 42, and there is a flow divider 48 that causes approximately equal flow through both chambers. Also as shown in FIG. 1, there is a flow divider 50 that causes liquid coolant to flow through the skirt passageway 52 between the cylinder caps 14.

As previously stated, the piston is shown in its top dead center position in which the compression rings are cooled by the skirt having the liquid cooling chamber therein. This region will be referred to as region A. The area below the skirt all the way to the bottom dead center position of the piston will be referred to as region B. In FIG. 2, region B is cooled by airflow across and between the cylinder barrel cooling fins. Those skilled in the art would also recognize that the cylinder barrels could also be cooled by a separate water jacket instead of air fins. Depending on the length of the skirt 38, it is also possible to eliminate external cooling of zone B entirely. The engine lubricating oil can remove the minimal heat required to be rejected in this region. The amount of heat which must be removed from the combustion chamber in region A is approximately 80%, while the heat which must be removed from region B is approximately 20% of the total heat that must be removed. Most of the heat that must be removed from the piston is actually removed through the compression rings when near their top dead center position. The heat that is removed in region B is removed through the air fins in depicted embodiment. Some heat however, is removed by the oil that is sprayed up onto the under side of the piston.

The top end of the cylinder under ambient conditions has a slip fit with respect to the inner walls of the skirt. This slip fit is designed so that under operating conditions the steel cylinder expands more than the aluminum head to provide solid contact and good heat transfer from the cylinder wall into the water jacket. The cylinders may also be pressed into the head to provide maximum heat transfer.

The stud columns 18 through which the hold down studs pass have approximately half of their outer surface exposed to the liquid coolant. In addition, water path 42 passes in between column 18 and the exhaust ports. This limits the thermal expansion of these mounting stud columns and thus the tension on the hold down studs by 40% over air-cooled heads. These thermally induced stresses in the mounting studs are notorious for causing cracks to develop in the crankcase in prior art designs.

As best seen in FIG. 2, the exhaust port above the valve seat turns directly out of the plane of the paper to the outlet connection for the exhaust system. The inlet port extends laterally in smooth arc path directly to the connection for the intake manifold. In prior art designs of air-cooled heads, the inlet port was shifted to allow air from the cooling fan to pass over the exhaust valve guide. This tortuous path of the intake port has limited the breathing capability and hence power output of the prior art design. In the present invention the exhaust valve guide is liquid cooled, thereby permitting a large non-torturous intake port and greater power output.

As previously stated aluminum material properties are significantly reduced at elevated temperatures. At the same time temperature is reducing the material properties it is inducing greater stresses. Typical liquid cooled heads reach 475 F in the bridge area between the intake & exhaust valve seats. Air-cooled cylinder heads can go substantially ubove this temperature. Measurements of the head of the present invention have not exceeded 320 F in this region. In the prior art air-cooled heads that are cooled by a fan, the fan consumes as much as 25 horsepower. The mechanical fan can be eliminated when using the heads of the present invention.

It will be understood that while the heads shown and described were made to replace the air cooled heads of a VW engine, the principles described as well as others can be incorporated into other types of internal combustion engines be they of the diesel cycle or otto cycle type.

While this invention has been described in considerable detail I do not wish to be limited to these particular embodiments shown and described. It is my intention to cover hereby all adaptations, modifications and arrangements thereof, which will occur to those skilled in the art to which the invention relates.

SUMMARY

The present invention divides the cooling in an internal combustion engine into zone A and zone B. Zone A extends from the top dead center position of the pistons compression rings upwardly over the combustion chamber. Zone B is the area below zone A from which heat needs to be removed. Cylinder heads are provided with a dependent skirt having a liquid cooling passage therein which effects heat removal from the combustion chamber perimeter, piston, piston rings, the squish area, and the sealing surface between the cylinder and the cylinder head. Liquid coolant is introduced directly into the cooling chamber of the skirt and in addition a portion of it blankets the top of the combustion chamber to flow around the valve seats and valve guides. The intake port communicates the outside of the head to the intake valve in a smooth direct path, resulting in better breathing and greater horsepower. The coolant passageway through the skirt and the coolant passageway over the combustion chamber remove approximately 80% of the total heat to be removed. This water jacket is so efficient at removing heat from the combustion chamber that material properties are doubled over prior art heads at full load conditions. The better cooling of the heads results in greater efficiency, power, durability, longevity, less warpage, lower oil temperatures, and eliminates cracking of the case as occurs in prior art engines.

I claim:

1. In an internal combustion engine of the type having air cooled cylinder walls and a liquid cooled head, the improvement comprising: a cylinder barrel having a piston therein whose top dead center position is adjacent the top of said cylinder barrel, and a cylinder head having a skirt which overlaps said top of said cylinder chamber and a gas sealing surface which abuts said top of said cylinder barrel, said head having a combustion chamber over said piston when in its top dead center position, said head having a liquid coolant chamber in said skirt, and a liquid inlet port opening into said skirt causing coolant to be distributed generally equally around said skirt and said gas sealing surface.

2. A cylinder head for an internal combustion engine of a type having a tubular shaped cylinder barrel with a compression ring fitted piston therein which cooperate to form a combustion chamber which produces appreciable squish gases adjacent the top dead center position of the piston; an intake valve seat and an exhaust valve seat the bottom of which communicate with said combustion chamber; an intake passage way communicating with the top of said intake valve seat; an exhaust passageway communicating with the top of said exhaust valve seat; an intake valve guide above said inlet valve seat and communicating with said inlet passageway; an exhaust valve guide above said exhaust valve seat and communicating with said exhaust passageway; said head having a liquid cooling chamber above and generally paralleling its surface exposed to the combustion chamber; said cooling chamber passing around said intake passageway and said exhaust passageway adjacent the valve seats and surrounding said exhaust valve guide; said head having a coolant inlet and an outlet port communicating with said coolant chamber for flowing liquid coolant through said chamber; and said chamber being constructed and arranged to provide turbulent flow across all portions thereof and being constructed and arranged to cool said squish gasses.

3. The cylinder head of claim 2 comprising: a depending skirt surrounding the top end of said cylinder barrel and the top dead center position of the piston therein and overlying the region opposite the compression rings of the piston when in its top dead center position.

4. The cylinder head of claim 3 wherein said skirt has a slip fit clearance with the cylinder that it is designed to cooperate with at ambient temperatures but which will have a metal to metal contact with the cylinder at operating temperatures.

5. The cylinder head of claim 3 wherein said skirt has a cooling chamber therein and both cooling chambers are designed to have turbulent flow and wherein both chambers are constructed and arranged to remove approximately 80% of the cooling required by the cooperating cylinder.

6. The cylinder head of claim 5 wherein said cooling chambers cooperate to limit the temperature between said valve seats to below 340 degrees F. under all operating conditions of the engine.

7. The cylinder head of claim 6 wherein said head is constructed and arranged to receive two cylinders adjacent each other with said skirt extending around both cylinders and with said inlet port being adjacent one cylinder and said exhaust outlet port being adjacent the other cylinder.

8. A cylinder head adapted to cooperate with two cylinders in a side by side arrangement, said head comprising: a casting having two side by side recesses adapted to receive the side by side cylinders and cover the squish region of cylinders received in said recesses; a depending skirt surrounding said recesses, said skirt having a liquid cooling chamber therein with a coolant inlet port for said chamber adjacent one recess and an outlet port adjacent the other recess, said cooling chamber being constructed and arranged to produce turbulent flow around all sides of both recesses with substantially no pockets through which coolant does not flow.

9. The cylinder head of claim 8 having an intake valve seat and an exhaust valve seat in its bottom surface within each recess, said cylinder head having a second coolant chamber extending between said inlet port and said outlet port and which generally blankets both cylinder recesses and flows past all valve seats, said second coolant chamber being constructed and arranged to direct turbulent coolant flow around said intake and exhaust valve seats to a degree keeping the area between the valve seats below approximately 340 degrees F. under all operating conditions.

10. The cylinder head of claim 9 wherein said skirt is constructed and arranged to have a slip fit clearance at ambient temperatures with each cooperating cylinder, but which clearance is eliminated at operating temperatures to give metal to metal contact with the cooperating cylinders at operating temperatures thereby achieving maximum heat transfer.

11. In an internal combustion engine: first separate and distinct means providing cooling of the combustion chamber down to and including the piston ring's at the top dead center position of the piston (Zone A), and separate and distinct means providing cooling of the cylinder below the piston rings at the top dead center position of the piston rings (Zone B); and wherein approximately 80% of the total heat removed in Zones A and B is removed in Zone A and approximately 20% of the heart is removed in Zone B.

12. A cylinder head for an internal combustion engine, said head been constructed an arranged to seal off the top of said combustion chamber, said head having a coolant skirt around the perimeter of the combustion chamber extending down opposite the pistons rings at the top dead center position of the piston; and wherein said skirt has a cooling chamber therein having liquid coolant inlet and exit ports to circulate high velocity coolant through the coolant chamber in said skirt.

13. The cylinder head of claim 12 having a cooling chamber fed by said inlet and outlet ports and which is constructed and arranged to provide coolant flow over the top of the combustion chamber and around valve seats and guides in a uniform fashion.

14. The cylinder head of claim 12 constructed and arranged to receive a cylinder barrel internally of said skirt and including sealing means between the head and the top of the cylinder barrel to prevent said skirt from being exposed to cylinder pressure thereby allowing the thickness of the skirt between the cylinder barrel and said cooling chamber to be of minimal thickness for maximum heat transfer.

15. The cylinder head of claim 12 wherein the cooling chamber of the skirt extends upwardly above the top of the cylinder barrel; whereby the inner wall of said skirt serves the purpose of a liquid cooled cooling fin extracting heat from the walls of the combustion chamber including valves and spark plugs.

16. A cylinder head for an internal combustion engine having at least two cylinders in series with a piston having pressure sealing rings in each cylinder, said head being constructed and arranged to seal off the top of the cylinders and having a coolant skirt extending down opposite the piston rings at the top dead center position of the pistons, said skirt having liquid coolant inlet and outlet ports entering and exiting said skirt to direct high velocity liquid coolant through said skirt.

17. The cylinder head of claim 16 in which the skirt chamber has a flow divider constructed and arranged to direct the flow between the cylinders and wherein the coolant flow that is introduced into the head passes in series fashion from one cylinder to the next maximizing velocities across all cylinders for a given flow rate.

18. The cylinder head of claim 17 constructed and arranged to replace a VW type 1, 2, 3, or 4 air cooled cylinder head.

19. The cylinder head of claim 16 which is constructed and arranged to provide coolant flow over the top of the combustion chamber and around valve seats and guides in uniform fashion.

* * * * *